United States Patent [19]

Newman

[11] Patent Number: 4,632,332

[45] Date of Patent: Dec. 30, 1986

[54] TEXTILE BOBBIN

[76] Inventor: Arnold S. Newman, 4170 Cove La., Glenview, Ill. 60025

[21] Appl. No.: 707,813

[22] Filed: Mar. 4, 1985

Related U.S. Application Data

[63] Continuation-in-part of Ser. No. 444,618, Nov. 26, 1982, Pat. No. 4,519,557.

[51] Int. Cl.[4] ..... B65H 75/10; B65H 75/20

[52] U.S. Cl. ..... 242/118.3; 242/118.32

[58] Field of Search ..... 242/118.3, 118.31, 118.32

[56] References Cited

U.S. PATENT DOCUMENTS

| | | | |
|---|---|---|---|
| 2,273,373 | 2/1942 | Perry | 242/118.3 |
| 3,141,631 | 7/1964 | Krebs | 242/118.3 |
| 3,361,381 | 1/1968 | Livingstone | 242/118.3 |
| 3,450,370 | 6/1969 | Hawkins | 242/118.32 |
| 3,532,291 | 10/1970 | Newman | 242/118.31 |
| 3,900,168 | 8/1975 | Hamilton | 242/118.32 |
| 4,519,557 | 5/1985 | Newman | 242/118.31 |

FOREIGN PATENT DOCUMENTS

| | | | |
|---|---|---|---|
| 201213 | 8/1955 | Australia | 242/118.3 |
| 707926 | 4/1955 | United Kingdom . | |
| 1240771 | 7/1971 | United Kingdom | 242/118.32 |
| 258955 | 11/1970 | U.S.S.R. | 242/118.31 |

*Primary Examiner*—Stuart S. Levy
*Assistant Examiner*—Katherine Matecki
*Attorney, Agent, or Firm*—Robert E. Browne; Ralph R. Rath

[57] ABSTRACT

A plastic bobbin consisting of a hollow cone defined by a thin-walled sheath includes an inner skeletal frame of longitudinally-spaced circumferential ribs and radially-spaced longitudinal ribs defining an inner support surface for a mandrel with a sheath having segments of varying wall thickness and the outer surface having constant taper with respect to the bobbin axis. Some of the longitudinally-extending ribs may be partial ribs defined in each of the segments, the bobbin has a helical ridge of a particular trapazoidal cross-sectional to provide a guiding surface for the yarn being wound thereon.

1 Claim, 6 Drawing Figures

TEXTILE BOBBIN

REFERENCE TO RELATED APPLICATION

The present invention is a continuation-in-part application of pending U.S. Ser. No. 444,618 filed Nov. 26, 1982, now U.S. Pat. No. 4,519,557.

DESCRIPTION

1. Technical Field

This invention relates generally to cores upon which filamentary material, such as yarn or thread, are to be wound and, more particularly, to an improved lightweight bobbin fashioned as a one-piece hollow cone molded from plastic material.

2. Background Prior Art

For purposes of simplicity, the filamentary materials with which the present invention is intended to be used will be referred to generally as "yarn", with the understanding that other filamentary materials are included as well.

Manfacture of yarn is carried out as a continuous operation, and as part of the manufacturing process, machines have been developed to automatically package yarn by winding into onto bobbins for storage, shipment and sale.

In a typical example, one such winding machine has a mandrel which rotates at a selectable speed, and onto which an empty bobbin or core is placed. Such mandrels may grip the bobbin with teeth, rubber collars, expandable and retractable "dogs", or O-rings. Various adjustments are then possible to alter the angle at which the yarn is wound, the tension on the yarn during winding, and the speed at which the bobbin is spun. Yarn is then wound onto the bobbin, preferably in a uniform pattern, until the desired quantity of yarn is loaded, and the full bobbin is then removed from the mandrel and replaced with an empty one.

Each such bobbin is thus required to withstand compressive forces occasioned by the winding of the yarn, the high-speed rotation of the bobbin, and the centrifugal forces created in the bobbin. Customarily, many such bobbins are cone-shaped, and the stresses incurred during winding are complex because the bobbin does not have a uniform cross-sectional configuration throughout its length.

Accordingly, bobbins manufactured for use with automatic winding machines must be strong enough structurally to withstand the rotational stresses induced during winding and must facilitate insertion onto and removal from the mandrel of the winding machine. As winding machines of different manufacturers vary in their constructions, do mandrel configurations and constructions differ, and the bobbin should preferably be constructed for use with a variety of mandrels.

Another important consideration is maintaining a close fit between the bobbin and the mandrel which will limit slippage, yet which will allow easy removal of the bobbin from the mandrel when winding is complete.

It has also been shown to be advantageous to have some form of guiding structure formed on the bobbin's outer surface to direct the first layer of yarn to be wound uniformly along the bobbin, making it possible for tight, uniform winding of yarn, which maximizes the amount of yarn carried on each bobbin, and facilitates dispensing of the yarn by the ultimate user. Past efforts in this area have included forming a series of concentric raised rings on the surface of the cone in order to grip the yarn during the first stages of winding. Another prior attempt to attract and direct the winding of the yarn is to "stipple" the surface of the bobbin with small, raised "dots". Typically, the surface of the stippled bobbin has a sandpaper-like feel, and prolonged handling of such bobbins is likely to abrade the user's hands unless gloves are worn.

The present invention offers advantages and improvements over prior bobbins. Exemplary of the prior art is my U.S. Pat. No. 3,532,291, showing the one-piece molded construction and reinforcing internal rib system currently in use.

In this patent, a thin-walled outer sheath is internally supported by a skeleton of axially-extending, radially-spaced ribs which intersect axially-spaced, circumferentially-extending ribs, with the entire bobbin cast as a single unitary structure from a plastic such as polypropylene. A series of circumferentially-extending concentric ridges are formed on the exterior surfaces of the sheath to form a surface for the collection and winding of yarn.

Other examples of bobbin constructions may be found in U.S. Pat. Nos. 2,273,373; 3,141,631; 3,450,370; 3,900,168; and British Patent Nos. 707,926 and 1,240,771; and U.S.S.R. Patent Nos. 258,955. As will become more clear below, the prior efforts noted above have not resulted in the improved construction set forth herein.

SUMMARY OF THE INVENTION

The present invention is intended to accomplish the desired results with a bobbin which is lightweight, strong and useable on a variety of mandrels, yet uses less raw material to manufacture, and does not require the use of gloves when handling.

In accordance with one aspect of the present invention, the outside surface of the bobbin sidewalls are formed with a constant slope, or "true taper", while the inner bobbin sidewalls vary in thickness along selected axial segments thereof, with the same inner wall segments formed at a true taper, and others at a different taper. Reinforcing ribs of uniform thickness are formed both axially and radially on the inner bobbin surface. Such a construction uses significantly less plastic material while maintaining the compressive strength required for use as a bobbin.

In yet another aspect of the invention, partial axially-extending skeletal ribs formed on the interior surfaces of the bobbin reinforce the thinner wall sections described above.

Another aspect of the invention is a circumferentially-extending inner reinforcing segment proximate the base of the bobbin. The reinforcing segment has a gripping surface formed thereon to create a tighter and more reliable fit on the mandrel of the yarn-winding apparatus.

Yet another aspect of the present invention includes a ridge formed on the exterior surface of the bobbin and extending circumferentially therearound from one end to the other in a helical pattern, with the crest of the ridge formed as a saw-toothed edge, rather than a rounded edge.

More specifically, the saw-tooth ridge has a minimum predetermined depth with respect to the outer surface of the bobbin and also has a predetermined critical face angle with respect to the axis of the cone.

Further aspects of the present invention will become more apparent upon consideration of the accompanying drawings and the detailed description of the invention which follows.

BRIEF DESCRIPTION OF SEVERAL VIEWS OF DRAWINGS

DETAILED DESCRIPTION

Figure 1:
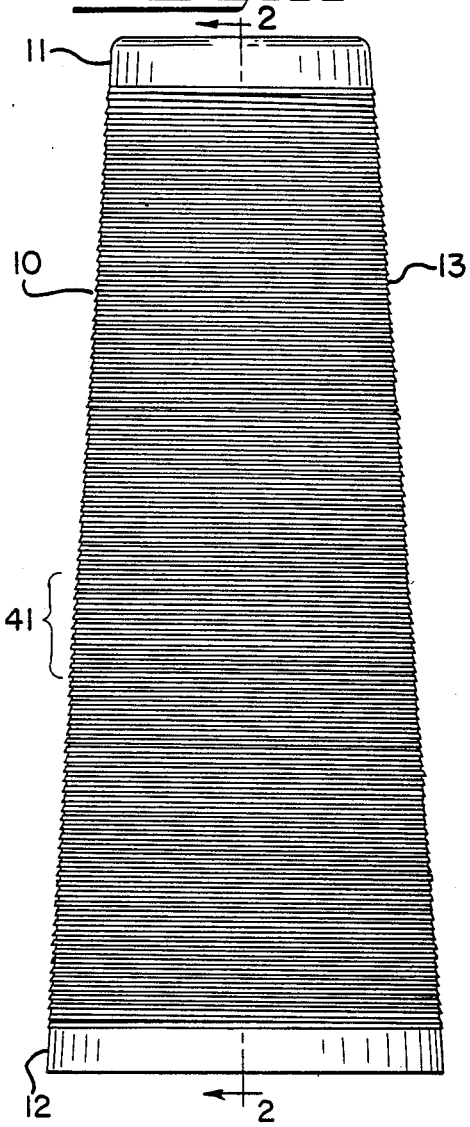
FIG. 1 is an elevational view of the exterior of a bobbin incorporating aspects of the present invention.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring now to FIG. 1, the numeral 10 indicates generally a bobbin or core made from plastic material, such as polypropylene, formed generally in a frustoconical configuration, and having a top section or tip end 11 and a bottom section or base end 12. Intermediate tip end 11 and base end 12, the exterior surface of bobbin 10 has formed thereon a single raised continuous helical thread 13 which, in one embodiment of the present invention, comprises a saw-tooth ridge wrapped in the shape of a helix on the otherwise smooth surface of bobbin 10, as shown in greater detail in FIG. 4.

Figure 2:
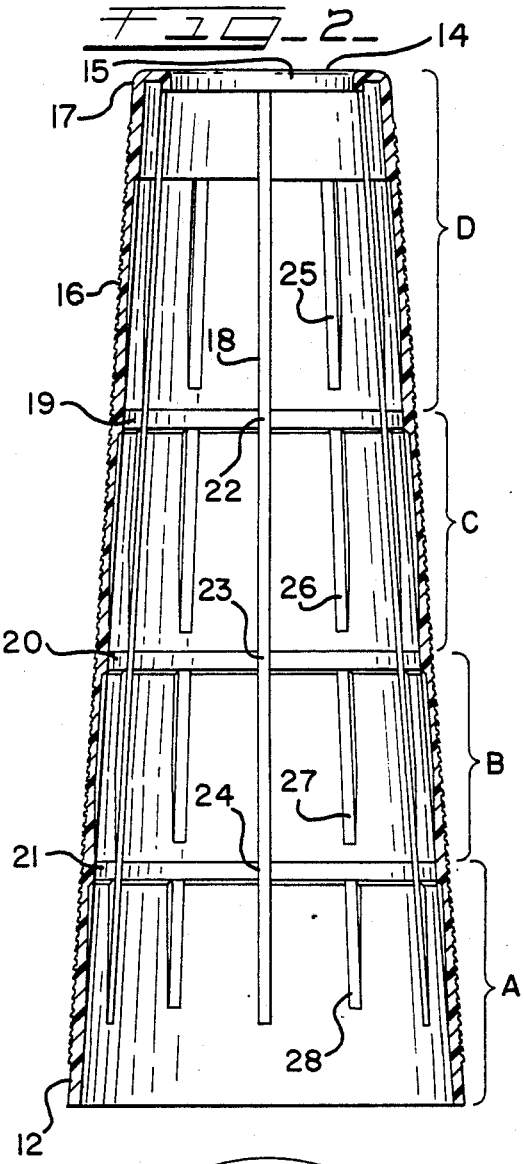
FIG. 2 is a sectional view taken along line 2—2 of FIG. 1.
Figure 3:
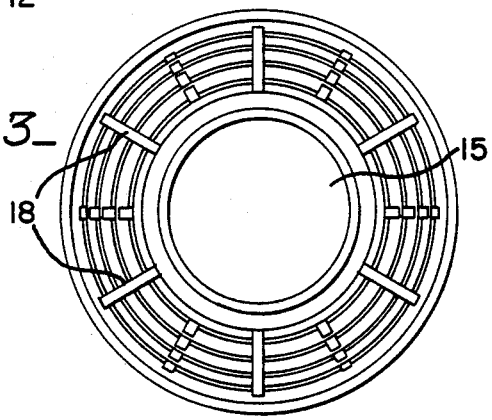
FIG. 3 is a bottom view of the embodiment illustrated in FIG. 2.

Referring now to FIG. 2, tip end 11 is shown having a dome-shaped top 14 surrounding a central aperture 15 which is better seen in FIG. 3. As seen in FIG. 2, the relative thickness of the bobbin sidewall 16 at tip end 11, and the configuration of the dome-shaped tip 14 act to reinforce tip end 11.

It should be understood throughout this description of the present invention that, although certain features or embodiments are described as being "formed on" the bobbin, the bobbin is, in its preferred form, injection-molded as a unitary structure, and all of the structure so described is integral with the bobbin. In other words, in its preferred form, the bobbin is a one-piece construction, rather than a substrate with various surface details added thereto, such as by adhesives or fasteners.

As best seen in FIGS. 2 and 3, a preferred embodiment of the present invention has a series of longitudinally- or axially-extending skeletal ribs formed on the interior of bobbin 10. In the embodiment of the present invention, illustrated in FIG. 2, a number of full ribs 18 extend from tip end 11 to a point proximate base end 12, and the ribs are tapered at the lower or base end to merge and blend in with the inner surface of bobbin 10. In FIG. 3, the construction illustrated utilizes a series of six such full ribs equally spaced about the interior surface of bobbin 10.

Also illustrated in FIG. 2 is a series of circumferentially-extending skeletal or circular ribs 19, 20 and 21. Ribs 19, 20 and 21 are formed concentrically along the axis of bobbin 10, and intersect full ribs 18 at, for example, junctures 22, 23 and 24 of FIG. 2.

The embodiment depicted in FIG. 2 also includes a series of shortened or partial longitudinally-extending ribs, exemplified by the numerals 25, 26, 27 and 28. Generally, each such partial rib, when viewed within bobbin 10, appears thickest where it intersects a circular rib, and thereafter appears to blend in with the inner surface bobbin 10. The nature and character of the construction of such partial ribs will be more extensively developed hereinafter when further details of the sidewall construction of bobbin 10 are discussed.

Figures 4, 5, 6:
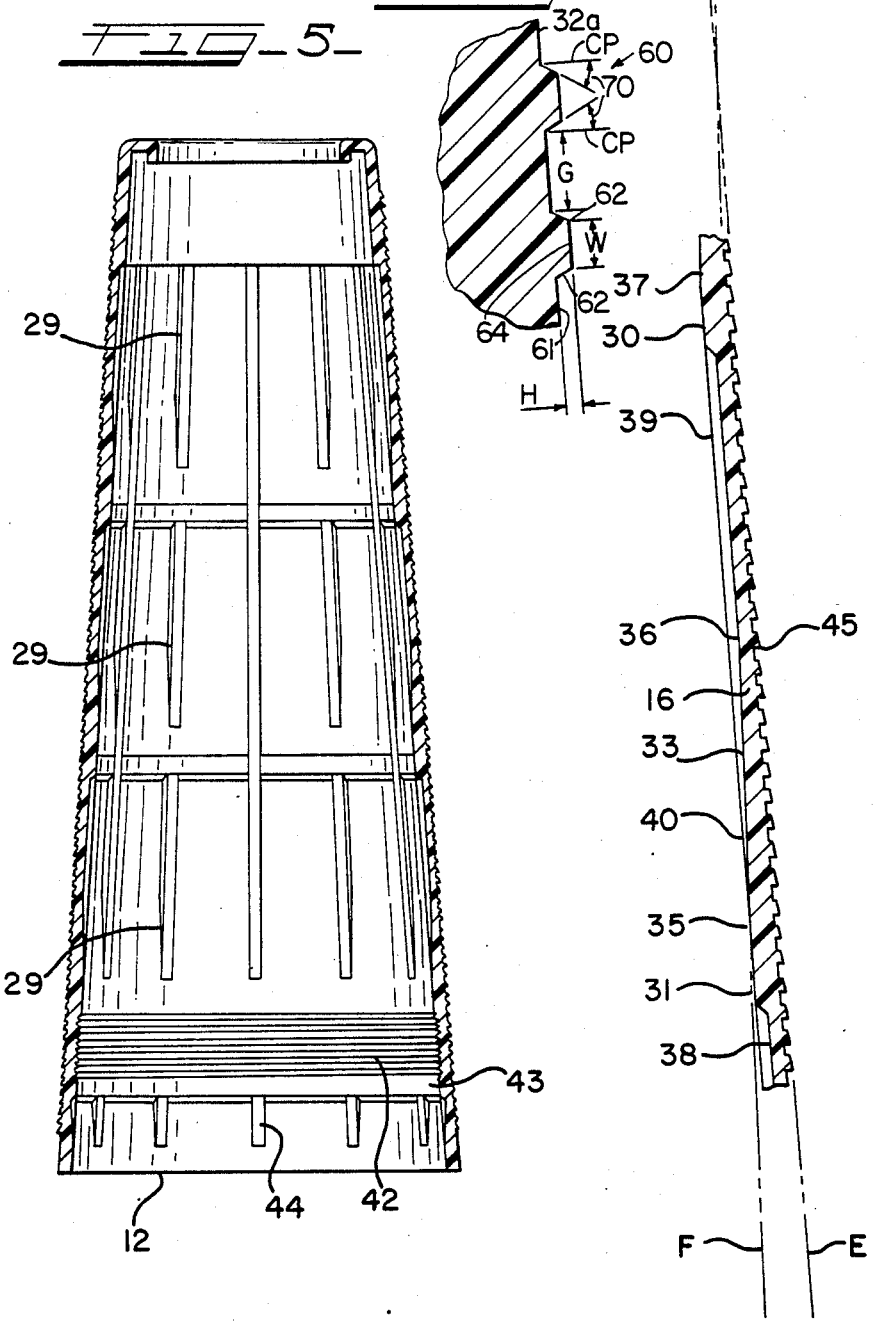
FIG. 4 is a partial sectional view of the wall of the embodiment shown in FIG. 2.
FIG. 5 is a sectional view of a second embodiment of the present invention; and, FIG. 6 is an enlarged cross-sectional view showing details of the bobbin outer surface.

Referring now to FIGS. 2 and 4, and more particularly to the details of construction of the sidewalls of bobbin 10, the thickness of the sidewall 16 varies. In the embodiment shown in FIG. 2, longitudinal segments of cone 10 have been divided, for purposes of illustration, into segments A, B, C and D, and a partial side sectional view representative of one such section is shown in FIG. 4. The segment in FIG. 4 extends from a first circular rib 20 downward to a second circular rib 21, as a typical section. As seen in FIG. 4, the exterior surface of sidewall 16 is formed with a constant taper relative to the axis of bobbin 10, as illustrated by line E, which defines an included angle with respect to the center axis of the bobbin 10. One such taper or included angle utilized in such bobbins is 5°57′ as measured by a line coextensive with the outer bobbin wall intersecting the axis of the bobbin.

As typified by line F, an interior surface segment 33 of sidewall 16 is formed with a taper which differs from that of exterior surface 32 to define an included angle with respect to the center axis which is less than the included angle of the exterior surface. The result of such taper is to create a wall section with segments of varying thickness. One such taper or included angle for inner surface segment 33 (measured in the same fashion as the exterior surface taper) found to be effective is approximately 5°54′.

The embodiment of FIG. 4 is characterized by a sidewall construction at which the wall is at its thickest at 35, that is, at its juncture with the upper part of circular rib 21, and which thereafter tapers to narrow until it reaches point 36, and thereafter continues at a uniform thickness until it meets circular rib 20. Thus, sidewall 16 has a maximum thickness adjacent rib 21, which is substantially equal to the thickness of the rib 21 extending inwardly of sidewall 16 and reduces in thickness approximately one-half the distance between circular ribs 20 and 21 where it becomes a constant thickness to the next rib 20. Another such construction may have the taper continue from circular rib 21 where it meets circular rib 20. As seen in FIG. 4, the next uppermost wall section 37 begins with a thickened segment at the top of circular rib 20, while the next subjacent wall section 38 terminates with a narrowed portion at circular rib 21.

In this fashion, less plastic material is required to manufacture each bobbin 10, while the arrangement of full and partial longitudinal ribs, and circular ribs, provides the robbin construction with the strength to resist the compressive and centrifugal forces described hereinabove, encountered when bobbin 10 is placed upon a spinning mandrel and used to wind yarn.

As seen in FIG. 4, partial rib 27 is actually of substantially constant thickness and has an inner surface 39 which has a taper with respect to the center axis that is substantially the same as outer surface 32. The lower end of rib 27 blends in with sidewall 16 as at 40, when the thickness of the rib 27 matches the maximum thickness of sidewall 16. Thus, with respect to the partial ribs at least a portion of each such rib is equal to or less than the thickness of one portion of sidewall 16. With respect to longitudinal rib 18, such rib is formed with a thickness which equals the maximum thickness of wall section 16, and is formed with the same inner taper as the outer taper of sidewall 16 of bobbin 10. A preferred embodiment of the circular ribs shown at, for example, 20 and 21 of FIG. 4, has each such circular rib formed with a constant thickness.

Thus, in one version of the present invention, bobbin 10 has a first section A within which the wall thickness tapers upward from base end 12 to first circular rib 21, a second section B with a thickened base tapering upward to circular rib 20, a third section C with a wall section tapering upward to circular rib 19 and a fourth section D with a wall section which tapers upward to tip end 11.

Referring now to FIGS. 1 and 4, the numeral 41 indicates generally the raised, continuous, helically-formed saw-tooth thread about the circumference of bobbin 10. As seen in FIG. 4, said thread 41 is formed with sharp, downwardly-facing edges 45 which enable the surface of cone 10 to more effectively snag a yarn segment to initiate the winding operation, yet which allows for easy removal of the finished bobbin from its mold.

In yet another preferred embodiment, illustrated in FIG. 5, bobbin 10 has internally-formed surface grooves 42 about a section of the inner periphery of bobbin 10 proximate base end 12. The grooves so formed provide a gripping segment which enhances the holding of bobbin 10 on the mandrel of an automatic winding apparatus. Preferably, grooves 42 are formed to be contiguous with a circular rib, such as 43, and a series of shortened partial ribs 44 may also be formed in order to reinforce the base end 12 of bobbin 10. Grooves 42 also provides advantages in separating bobbins which are shipped nested one within the other and in removing bobbin 10 from a mandrel when winding is complete.

Grooves 42 and full ribs, such as 18, form a bearing surface for a mandrel. At least three such ribs 18, formed with a true taper and constant thickness equal to or exceeding the maximum wall thickness of bobbin 10, are spaced equidistantly about the inner periphery of bobbin 10. A preferred version of bobbin 10 utilizes six such full or true taper ribs alternating with axially-spaced partial ribs. Full ribs 18 should be spaced uniformly about the interior of bobbin 10, such that each full rib is the same distance from its preceding and following full ribs, i.e., three full ribs would be placed at 120° intervals, four full ribs at 90° intervals, five full ribs at 72° intervals, six full ribs at 60° intervals, etc.

As seen in FIG. 5, use of partial ribs 29 and 44 can represent a greater saving of raw material, where no such ribs hereto exceeds the thickness of sidewall 16 throughout the entire length of bobbin 10. In one such version of bobbin 10, use of partial ribs and varying wall thicknesses enabled the saving of 25 pounds of polypropylene per 1,000 bobbins.

Placement of circular ribs, such as 19, 20 and 21, may vary with the size and exterior taper of bobbin 10. Also, the number of circular ribs and the number of inner surface segments 33 may vary and the location thereof may be changed dependent upon the length and diameter of the bobbin. However, in this version of the invention, the inner surfaces of the partial ribs 29 and the circular ribs 19, 20 and 21, as well as continuous skeletal ribs 18, provide the primary contact with the mandrel and the discontinuations provide gripping edges for the bobbin on the mandrel during rotation but will assist in removal of the bobbin from the mandrel.

Various other modifications of the rib and sidewall configuration could also be utilized. For example, the varying wall thickness and circular ribs could be used in only part of the axial length of the bobbin, while the remainder of the inner surface could be grooved with grooves 42. In addition to the segments having varying wall thicknesses, the entire sidewall could also have a -contantly-increasing thickness from the tip end 11, which is the most rigid, to the base end 12. In this instance, the continuous ribs 18 could have a thickness substantially equal to the thickness of the sidewall and the base end 12, or in some instances, slightly less than such maximum thickness. In other instances, the continuous ribs could be eliminated and only the partial ribs used in conjunction with the varying thickness segments.

According to one further aspect of the present invention, the exterior surface 32 of the bobbin is designed with a plurality of configured helical ridges or other roughing characteristics that will allow for easy, even winding of the yarn, prevent sloughing, and to accommodate ready removal of the yarn at the point of use.

While various roughening characteristics have been proposed, such as disclosed in U.S. Pat. Nos. 3,141,631 and 3,900,168, for use with molded plastic bobbins, such units have serious drawbacks in providing the proper surface characteristics to prevent surface slippage of the yarn, when it is a synthetic yarn, and still be easily duplicated and manufactured at a minimum cost. Furthermore, when the roughening is molded into the core, such as suggested in the above patents, difficulties are encountered in removing the finished bobbin or core from the mold without damaging the ridges. Also, the roughened or sandblasted surface is suitable to the user requiring gloves which constantly become snagged on the roughened surface.

Accordingly, a modified form of core roughing is illustrated in FIG. 6. In FIG. 6, the outer surface **32*a* of the sidewall 16*a* is provided with a continous helical ridge 60 defining a continuous groove or trough 61** on the surface. The ridge is preferably trapezoidal in cross-section and dimensioned and configured so that the finished bobbin can easily be pulled off the mold without damaging the surface characteristics.

The cross-sectional configuration of the helical ridge includes opposed inclined walls 62 that are joined to each other by a substantially flat wall 64. The flat wall 64 is spaced from the outer surface **32*a* of sidewall 16*a* by a critical dimension, which has been indicated by reference numeral H. Also, the inclined walls also have a critical face angle, as measured from a plane CP, extending perpendicular to the axis of bobbin 10, and this face angle has been identified by reference numeral 70**.

Actual tests have shown that having a face angle of about 30° and a ridge having a height H of about 0.004 inches to about 0.005 inches allows the ridged or threaded bobbin to be easily pulled from the mold without damaging the threads or ridge.

While not necessary to the practice of this aspect of the invention, it was also determined that the helical ridge or thread is preferably a right-hand thread which will allow the yarn to "track" more easily during the winding operation and which also accommodates separation of bobbins when they are telescoped onto each other for shipment and storage.

In summary, it has been found that the above face angle and the critical ridge height combined to ease the separation process after the molding operation and, at the same time, allow for easy take-up of the yarn on the bobbin and prevent sloughing, which has been a problem relating to removal of the yarn after the bobbin has been stored.

To complete the description of the ridge configuration, particular reference must also be made to the width W of ridge 62 and the width G of the groove between the ridges, which do not appear to be as critical as those described above. The width W of the ridge is preferably greater than the height H, and more desirably several times the height H, preferably about three times the height.

Also, the width G of the groove 61 is preferably greater than the width W of helical ridge 60, and more desirably several times greater. In one specific instance, which has been proven to be satisfactory, the width W of the ridge 60 was on the order of 0.015 inches, while the width G of the groove 61 was on the order of 0.050 inches.

Of course, other dimensions and variants could be used without departing from the spirit and object of this aspect of the invention, such as roughening of the flat wall 64, if desired.

While the foregoing has described certain specific embodiments of the present invention, it is to be understood that these embodiments are being presented by way of example only. It is expected that others skilled in the art will perceive variations which, while differing from the foregoing, do not depart from the spirit and scope of the invention herein described and claimed.

I claim:

1. A plastic textile bobbin for winding yarn comprising a hollow frusto-conical body having an exterior surface tapered from a circular base end to a relatively smaller truncated end, said exterior surface having a continuous, helical outwardly-extending ridge having a generally trapezoidal cross-section defined by opposed inclined flat walls tapered toward each other and an outer flat wall interconnecting said flat inclined walls, said inclined flat walls producing opposite face angles of about 30° with respect to a plane extending peripendicular to an axis through the center of said bobbin, said ridge having a height of about 0.005 inch and said outer flat wall having a width greater than the height of said ridge.

* * * * *